United States Patent [19]

Fiterman

[11] Patent Number: 4,803,813

[45] Date of Patent: Feb. 14, 1989

[54] FOLDABLE CORRUGATED PLASTIC ROOF VENTILATOR

[75] Inventor: Michael Fiterman, Minnetonka, Minn.

[73] Assignee: Liberty Diversified Industries, New Hope, Minn.

[21] Appl. No.: 227,080

[22] Filed: Aug. 1, 1988

[51] Int. Cl.[4] ..... L04H 12/28

[52] U.S. Cl. ..... 52/199; 52/57; 98/42.21; 156/227; 156/71

[58] Field of Search ..... 52/199, 57, 22; 98/42.2, 42.21, 42.22; 156/227, 71

[56] References Cited

U.S. PATENT DOCUMENTS

| | | | |
|---|---|---|---|
| 3,036,508 | 5/1962 | Halvorson | 98/42.21 |
| 3,236,170 | 2/1966 | Meyer | 52/22 |
| 3,515,036 | 6/1970 | Takehiro | 156/227 |
| 3,949,657 | 4/1976 | Sells | 52/199 |
| 4,199,387 | 4/1980 | Hladik | 156/227 |

*Primary Examiner*—Henry E. Raduazo

*Attorney, Agent, or Firm*—Moore & Hansen

[57] ABSTRACT

A pleated ridge cap ventilator constructed from a single, generally square sheet of double-faced corrugated polyethylene sheet material which is cut and scored into a series of interconnected longitudinal panels. Each score line alternately cuts entirely through one of the two opposing planar plies of the blank and through the intermediate corrugated ply, leaving the remaining planar ply intact to hingedly connect the adjoining panels. The widths of the panels form a generally increasing progression from the outer edge panels inwardly to the center panels. The center panels are connected by removing a wider section of one planar ply and the intermediate corrugated ply, leaving the opposing planar ply to act as a bridge. The blank is then accordion folded along the score lines to form two inverted pyramid-shaped ventilating sections joined at the top by the bridge, which are bent downwardly relative to one another into an inverted V-shape of approximately the same angle as the slope of the roof. The ridge cap ventilator is then disposed over an open cutout in the peak of the roof, covered with shingles, and attached to the roof using nails or similar fasteners.

20 Claims, 2 Drawing Sheets

FOLDABLE CORRUGATED PLASTIC ROOF VENTILATOR

BACKGROUND OF THE INVENTION

This invention relates generally to ridge cap ventilators for the peaked roof of a house, and particularly to a ridge cap cover folded from a cut and scored blank of double-faced corrugated plastic.

Proper ventilation of the roof area of a building is essential both in buildings having an interior ceiling or an open interior structure in order to prevent the accumulation of hot air and moisture. Many products have been developed to provide varying forms of ventilation, either separate ventilation structures or building materials having ventilating properties. Some representative examples of these structures are shown in U.S. Pat. Nos. 1,230,305; 2,060,002; 2,214,886; 2,207,671; 2,556,784; 2,579,662; 2,737,876; 2,782,129; 2,847,948; 2,868,104; 3,073,235; 3,311,047; 3,481,263 and 3,625,134.

One particular type of design calls for the ridge peak of a roof to be cut open, and a ventilated cover having an inverted V-shape corresponding to the angle of the roof to be disposed over that open area and attached to the roof along each side of the peak. The ventilation is provided by slots or apertures extending in a direction from the peak downwardly toward the gutter or soffit.

U.S. Pat. No. 3,236,170 to Meyer discloses such a ventilated roof construction where the inverted V-shaped ridge cap is made from two single-layer sections of corrugated metal which are connected near the peak and covered with shingles.

U.S. Pat. No. 3,949,657 to Sell discloses a structure where the ventilator is made from two interconnected blocks of a honeycombed corrugated fiberboard treated with a water repellent coating. The Sells '657 cap has beveled inner and outer edges, and is attached to the roof using nails and covered with shingles. The corrugations produce small tubes oriented perpendicular to the peak which help prevent insects and wind driven moisture from being admitted.

U.S. Pat. No. 4,280,399 to Cunning shows a corrugated ridge cap ventilator with the corrugations running parallel with the peak, and the ventilation being accomplished by slots in the corrugated material.

U.S. Pat. No. 4,676,147 to Mankowski discloses a ridge cap ventilator of the same general type wherein the cap is generally open, but has a plurality of apertures along a wall parallel with the peak of the roof.

Each of these ridge cap ventilators produce suitable ventilation, but have significant limitations. The ventilator structures themselves are very bulky and their non-uniform shapes make packaging and shipping the product more difficult and expensive. The ventilators are difficult to modify or customize in the field, even with the appropriate equipment, and in order to be durable the ventilators must be constructed of heavy and more expensive building materials.

BRIEF SUMMARY OF THE INVENTION

It is therefore one object of this invention to design a ridge cap ventilator such that a multiplicity of like ventilators can be packaged in a very efficient bundle for shipping.

It is another object of this invention to design the above ridge cap ventilator to be extremely durable, provide for reliable ventilation while restricting moisture and insects, and yet be very lightweight.

It is yet another object of this invention to design the above ridge cap ventilator such that it can be quickly and easily assembled, modified, and installed in the field with the minimum amount of basic equipment normally available.

Briefly described, the pleated ridge cap ventilator of this invention is constructed from a single, generally square sheet of double-faced corrugated polyethylene sheet material which is cut and scored into a series of interconnected longitudinal panels. Each score line alternately cuts entirely through one of the two opposing planar plies of the blank and through the intermediate corrugated ply, leaving the remaining planar ply intact to hingedly connect the adjoining panels. The widths of the panels form a generally increasing progression from the outer edge panels inwardly to the center panels. The center panels are connected by removing a wider section of one planar ply and the intermediate corrugated ply, leaving the opposing planar ply to act as a bridge. The blank is then accordion folded along the score lines to form two inverted pyramid-shaped ventilating sections joined at the top by the bridge, which are bent downwardly relative to one another into an inverted v-shape of approximately the same angle as the slope of the roof. The ridge cap ventilator is then disposed over an open cutout in the peak of the roof, covered with shingles, and attached to the roof using nails or similar fasteners.

DESCRIPTION OF THE PREFERRED EMBODIMENT

The ridge cap ventilator cover of this invention is shown in FIGS. 1–8 and referenced generally therein by the numeral 10.

Figure 1:
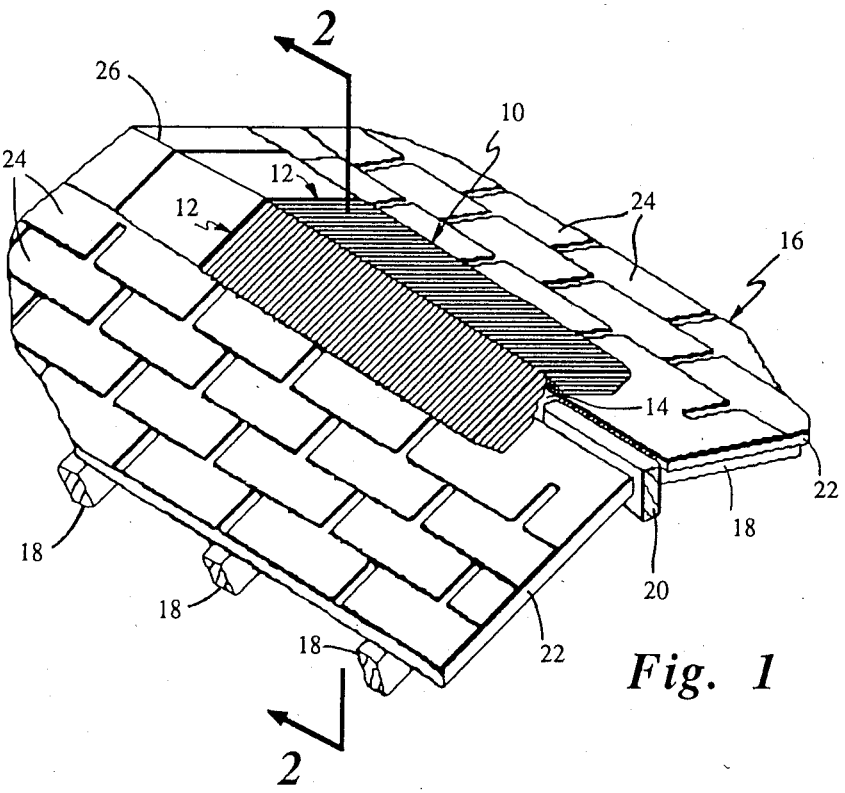
FIG. 1 is a perspective view of the ridge cap ventilator cover installed on the roof of a building.
Figure 2:
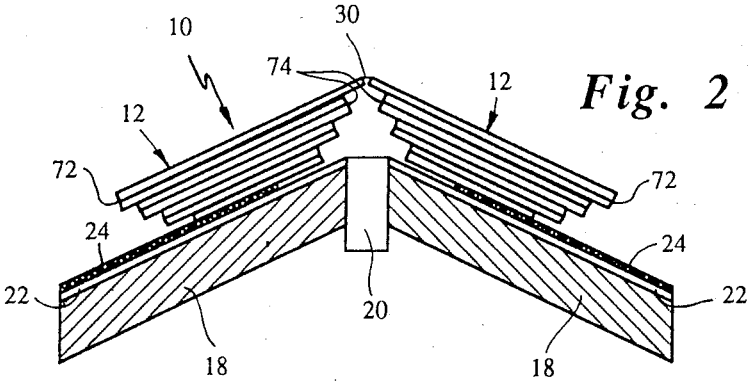
FIG. 2 is a side cross section view of the ridge cap ventilator cover of FIG. 1 taken through line 2—2 of FIG. 1.

Referring particularly to FIGS. 1 and 2, it may be seen that the ridge cap ventilator cover 10 comprises a pair of ventilator sections 12 disposed over an open cutout 14 in the peak of a roof 16. The roof 16 is generally comprised of a plurality of angled joists or trestles 18 which are fastened to a center beam 20. The joists 18 and beam 20 are covered with overlays of plywood 22 and shingles 24, respectively, and together form a central peak or ridge 26.

Figure 3:
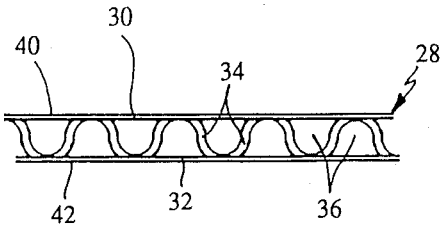
FIG. 3 is an end elevation view of the double-faced corrugated plastic sheet material used to fabricate the ridge cap ventilator cover of FIG. 1.

Referring to FIG. 3, the ridge cap ventilator cover 10 is fabricated from a generally planar section of double-faced corrugated plastic sheet material 28 such as polyethylene, preferably black in color. The double-faced corrugated plastic sheet material 28 includes a pair of generally planar spaced-apart plies 30, 32 which are connected by an intermediate corrugated ply 34 forming a multiplicity of parallel aligned air spaces 36 or partially enclosed channels defining a grain G to the double-faced corrugated plastic sheet material 28. In some embodiments, the double-faced corrugated plastic sheet material 28 may take on the configuration of a pair of parallel planar plies with a multiplicity of generally perpendicular connecting beams, due to the particular molding process involved in making the double-faced corrugated plastic sheet material 28.

Figure 4:
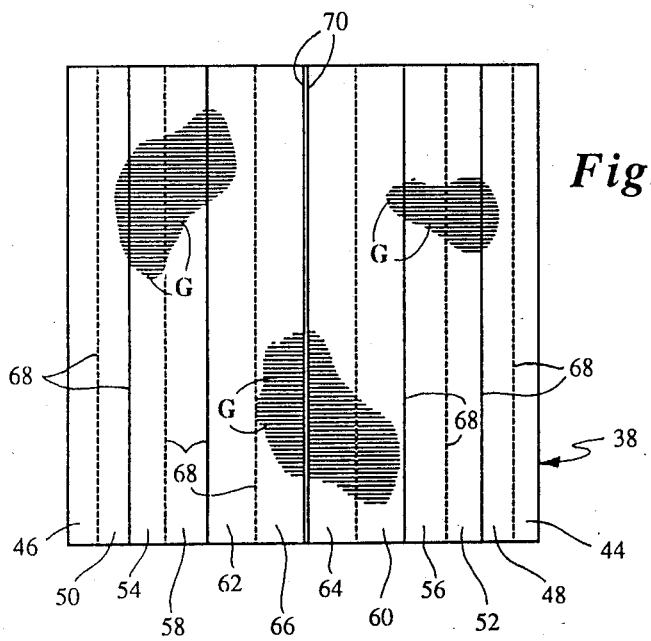
FIG. 4 is a bottom plan view of the blank from which the ridge cap ventilator cover of FIG. 1 is folded.

The double-faced corrugated plastic sheet material 28 is cut into a generally rectangular or square blank 38 as shown in FIG. 4, preferably with a length of approximately 48"–50" extending perpendicularly to the grain G, and a width generally parallel with the grain G of approximately 48". One of the planar plies 30 thereby forms a top planar surface 40, with the opposing planar ply 32 forming a bottom planar surface 42.

The blank 38 is cut and scored to form a series of pleated or hingedly interconnected longitudinal panels including a pair of end panels 44, 46, four pairs of intermediate panels including a first pair 48, 50, second pair 52, 54, third pair 56, 58, and fourth pair 60, 62, and a pair of center panels 64, 66.

Figure 6:
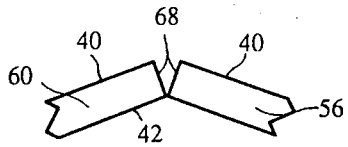
FIG. 6 is a side elevation view of one of the intermediate score lines of the ridge cap ventilator cover of FIG. 1.

Referring again to FIG. 4, it may be seen that the blank 38 is divided by lengthwise score lines 68 extending across or traversing the length of the blank 38 at a generally perpendicular angle relative to the grain G and the direction of extent of the channels 36. Each intermediate score line 68 alternately cuts entirely through one of the two opposing planar plies 30, 32 of the blank and ostensibly through the intermediate corrugated ply 34, leaving the remaining planar ply 32, 30 intact as shown in FIG. 6 to hingedly connect the adjoining end and intermediate panels 44 and 48, 48 and 52, 52 and 56, 56 and 60, 60 and 64, 66 and 62, 62 and 58, 58 and 54, 54 and 50, and 50 and 46. As shown in FIG. 4, with the blank 38 viewed from the bottom surface 42, the score lines 68 cutting through the top surface 40 of the blank 38 are shown in phantom.

The widths of each of the end panels 44, 46, first pair 48, 50, second pair 52, 54, third pair 56, 58, and fourth pair 60, 62 of intermediate panels, and center panels 64, 66 form a generally increasing progression from the outer edge panels 44, 46 inwardly toward the corresponding center panels 64, 66. Preferably, the end panels 44, 46 should have a width of approximately 2¾", with the width of each panel 48, 50, 52, 54, 56, 58, 60, 62, 64, and 66 being approximately ½" greater than the next adjoining outer panel 44, 46, 48, 50, 52, 54, 56, 58, 60, and 62, such that the width of each of the first pair of intermediate panels 48, 50 is 3-3/16", the width of each of the second pair of intermediate panels 52, 54 is 3-11/16", the width of each of the third pair of intermediate panels 56, 58 is 4-3/16", the width of each of the fourth pair of intermediate panels 60, 62 is 4-11/16", and the width of each of the center panels 64, 66 is 5½ for a total Width of 48" for the blank 38.

Figure 5:
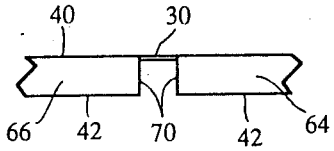
FIG. 5 is a side elevation view of the center score line of the ridge cap ventilator cover of FIG. 1.

Referring to FIG. 5, it may be seen that a center score line 70 is formed by removing a ¼" wide section of the bottom planar ply 32 and intermediate ply 34, leaving a ¼" strip of the top planar ply 30 to create a thin bridge segment joining and hingedly interconnecting the two halves of the blank 38 which form the two ventilator sections 12, with the center score line 70 generally defining a widthwise center line of the blank 38. The first pair of intermediate panels 48, 50 are disposed closer to the widthwise center than the end panels 44, 46, the second pair of intermediate panels 52, 54 are disposed closer to the widthwise center than the first pair of intermediate panels 48, 50, the third pair of intermediate panels 56, 58 are disposed closer to the widthwise center than the second pair of intermediate panels 52, 54, the fourth pair of intermediate panels 60, 62 are disposed closer to the widthwise center than the third pair of intermediate panels 52, 54, and the center panels 64, 66 are each disposed closer to the widthwise center than the fourth pair of intermediate panels 60, 62 and adjoin the widthwise center of the blank 38.

The panels 44, 46, 48, 50, 52, 54, 56, 58, 60, 62, 64, 66 thereby each contain a single layer of a multiplicity of channels 36 or air passages extending and communicating between the opposing side edges of each panel 44, 46, 48, 50, 52, 54, 56, 58, 60, 62, 64, 66 which are defined by the score lines 68, 70.

In operation, a multiplicity of the cut and scored blanks 38 are packed together in a stack or on end in the flattened form shown in FIG. 4 within a carton or box, thereby minimizing the volume per unit needed to store or ship the ridge cap ventilators 10.

Figure 7:
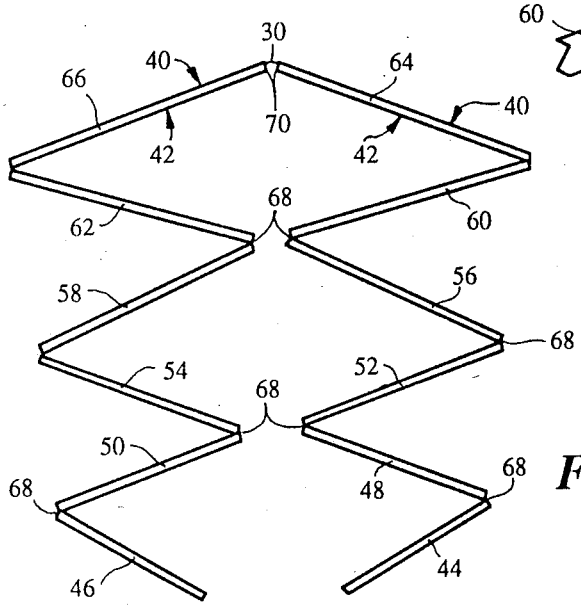
FIG. 7 is a side elevation view showing the blank of FIG. 4 being accordion folded.
Figure 8:
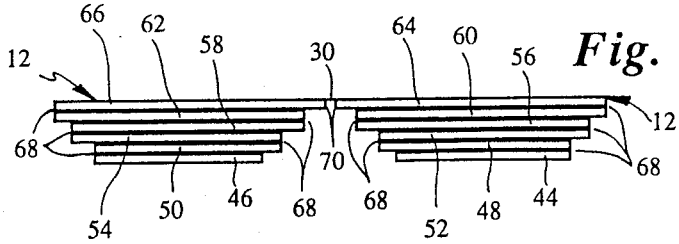
FIG. 8 is a side elevation view showing the blank of FIG. 4 completely folded in preparation for installation on the roof.

In order to install the ridge cap ventilator cover 10 as shown in FIGS. 1 and 2, the ridge cap ventilator cover 10 is removed from the carton, and folded in the accordion manner shown in FIG. 7 by pivoting the panels 44, 46, 48, 50, 52, 54, 56, 58, 62, 64, 66 across the score lines 68 until the top planar surface 40 of the first and third pair of intermediate panels 48, 50, 56, 58 are in close parallel confronting contact with the top planar surface 40 of the adjoining second and fourth pair of intermediate panels 52, 54, 60, 62 respectively, and the bottom planar surfaces 42 of the end panels 44, 46 are in close parallel confronting contact with the bottom planar surface 42 of the adjoining first pair of intermediate panels 48, 50, respectively, and the bottom planar surfaces 42 of the fourth pair of intermediate panels 60, 62 are in close parallel confronting contact with the bottom planar surface 42 of the adjoining center panels 64, 66 in a completely folded ventilating configuration as shown in FIG. 8 whereby each of the ventilating sections 12 form an inverted pyramid.

The ridge cap ventilator cover 10 is then disposed over an open cutout 14 in the roof 16 and each of the two ventilator sections 12 are folded downwardly across the bridge formed by the score lines 70 and planar ply 30 such that the top planar surface 40 of the end panels 44, 46 closely confront and contact the shingles 24 or plywood 22 of the roof 16 on each side of the peak 26 and open cutout 14 as shown in FIG. 2. Additional peak shingles 24 may be placed on top of the ridge cap ventilator cover 10, and the shingles 24 and ridge cap ventilator cover 10 are then securely fastened in this installed position on the roof 16 by adhesives or driving nails (not shown) through the shingles 24 and ridge cap ventilator cover 10 and into the plywood 22 or beams 18.

The air spaces or channels 36 in the corrugated plastic sheet material 28 defining the grain G are thereby oriented generally perpendicularly to the peak 26 of the roof 16 as shown in FIGS. 1 and 2, and the folded blank 38 creates a plurality of layers of thin tubular passages extending inwardly and upwardly from the outer ends 72 of the two ventilator segments 12 to the inner ends 74 thereof, to provide for ventilation between the exterior of the ridge cap ventilator cover 10 and the region enclosed by the two ventilator sections 12 and the bridge formed by the score lines 70 and planar ply 30. The channels 36 are partially enclosed to the extent that they form tubular passages which are open at each of the opposing ends 72, 74.

While the preferred embodiment of the above ridge cap ventilator cover 10 has been described in detail above with reference to the attached drawing figures, it is understood that various changes and adaptations may be made in the ridge cap ventilator cover 10 without departing from the spirit and scope of the appended claims.

What is claimed is:

1. A ventilator cover for disposing over an open cutout in a peak of a roof and permitting ventilation thereto from an exterior region surrounding said ventilator cover, said ventilator cover comprising:

a blank cut and scored from a double-faced corrugated sheet material, said blank having a length and a width, said double-faced corrugated sheet material having a pair of generally planar spaced-apart plies and an intermediate corrugated ply extending between and connected to each of said planar plies to form a single layer of a multiplicity of partially enclosed channels extending across the width of said blank and defining a grain, said blank being divided into a plurality of generally parallel hingedly interconnected panels by a plurality of lengthwise score lines extending through at least one of the planar plies at a generally perpendicular angle relative to said grain, each panel having a pair of opposing planar surfaces and a pair of opposing side edges and a multiplicity of partially enclosed air passages extending between said opposing side edges, such that the panels of the blank may be folded across the score lines into a ventilating configuration with at least one of the planar surfaces of each of the panels being in close confronting contact with at least one of the planar surfaces of an adjoining one of the panels to form a pair of ventilator sections, said ventilator sections being hingedly connected, whereby the ventilator cover may be disposed over the open cutout of the peak of the roof with each one of the ventilator sections positioned generally parallel to and on opposing sides of the peak of the roof and fastened thereto, such that the channels permit ventilation between the open cutout in the peak of the roof and the exterior region surrounding the ventilator cover.

2. The ventilator cover of claim 1 wherein the plurality of panels include a pair of end panels, a first pair of intermediate panels, a second pair of intermediate panels, a third pair of intermediate panels, a fourth pair of intermediate panels, and a pair of center panels.

3. The ventilator cover of claim 2 wherein the pair of generally planar spaced-apart plies includes a top ply and a bottom ply, and wherein the center panels are hingedly connected to one another along the lengths thereof by said top ply, the score line adjacent to and dividing the center panels being cut through said bottom ply and the intermediate corrugated ply.

4. The ventilator of claim 2 wherein the pair of generally planar spaced-apart plies includes a top ply and a bottom ply, each of the center panels being hingedly connected to one of the fourth pair of intermediate panels along the lengths thereof by said bottom ply, the score line adjacent to and dividing the center panels from the fourth pair of intermediate panels being cut through said top ply and the intermediate ply.

5. The ventilator of claim 2 wherein the pair of generally planar spaced-apart plies includes a top ply and a bottom ply, each of the fourth pair of intermediate panels being hingedly connected to one of the third pair of intermediate panels along the lengths thereof by said top ply, the score line adjacent to and dividing the fourth pair of intermediate panels from the third pair of intermediate panels being cut through said bottom ply and the intermediate ply.

6. The ventilator of claim 2 wherein the pair of generally planar spaced-apart plies includes a top ply and a bottom ply, each of the third pair of intermediate panels being hingedly connected to one of the second pair of intermediate panels along the lengths thereof by said bottom ply, the score line adjacent to and dividing the third pair of intermediate panels from the second pair of intermediate panels being cut through said top ply and the intermediate ply.

7. The ventilator of claim 2 wherein the pair of generally planar spaced-apart plies includes a top ply and a bottom ply, each of the second pair of intermediate panels being hingedly connected to one of the first pair of intermediate panels along the lengths thereof by said top ply, the score line adjacent to and dividing the second pair of intermediate panels from the first pair of intermediate panels being cut through said bottom ply and the intermediate ply.

8. The ventilator of claim 2 wherein the pair of generally planar spaced-apart plies includes a top ply and a bottom ply, each of the first pair of intermediate panels being hingedly connected to one of the end panels along the lengths thereof by said bottom ply, the score line adjacent to and dividing the first pair of intermediate panels from the end panels being cut through said top ply and the intermediate ply.

9. The ventilator cover of claim 2 wherein the blank has a widthwise center defined by the score line between the center panels, and wherein the end panels have a width, the first pair of intermediate panels have a width and are connected to the end panels and are disposed closer to said widthwise center of the blank than the end panels, the second pair of intermediate panels have a width and are connected to the first pair of intermediate panels and are disposed closer to the widthwise center of the blank than the first pair of intermediate panels, the third pair of intermediate panels have a width and are connected to the second pair of intermediate panels and are disposed closer to the widthwise center of the blank than the second pair of intermediate panels, the fourth pair of intermediate panels have a width and are connected to the third pair of intermediate panels and are disposed closer to the widthwise center of the blank than the third pair of intermediate panels, and the center panels each have a width and are connected to the fourth pair of intermediate panels and are disposed closer to the widthwise center of the blank than the fourth pair of intermediate panels.

10. The ventilator cover of claim 9 wherein the width of the first pair of intermediate panels is greater than the width of the end panels, the width of the second pair of intermediate panels is greater than the width of the first pair of intermediate panels, the width of the third pair of intermediate panels is greater than the width of the second pair of intermediate panels, the width of the fourth pair of intermediate panels is greater than the width of the third pair of intermediate panels, and the width of the center panels is greater than the width of the fourth pair of intermediate panels, such that each ventilator section forms an inverted pyramid when the blank is folded to the ventilating configuration.

11. The ventilator cover of claim 10 wherein the width of each of the end panels is between two and three inches, the width of each of the first pair of intermediate panels is between three and four inches, the width of each of the second pair of intermediate panels is between three and four inches, the width of each of the third pair of intermediate panels is between four and five inches, the width of each of the fourth pair of intermediate panels is between four and five inches, and the width of each of the center panels is greater than five inches.

12. The ventilator cover of claim 1 wherein the length of the blank is greater than or equal to forty eight inches and the width of the blank is approximately forty eight inches

13. The ventilator cover of claim wherein the pair of generally planar spaced-apart plies includes a top ply and a bottom ply, and wherein the ventilator sections are hingedly connected to one another by a thin bridge segment formed by said top ply.

14. The ventilator cover of claim 13 wherein the thin bridge segment has a width, said width being approximately one quarter inch.

15. A ventilator cover for disposing over an open cutout in the peak of a roof and permitting ventilation with an exterior region surrounding said ventilation cover and said roof, said ventilator cover comprising:

a plurality of panels, each panel having a length and a width and a pair of side edges and a pair of planar surfaces, said panels extending from and being hingedly connected to one other along said side edges thereof, each said panel being cut from a sheet material and having a multiplicity of partially enclosed air passages extending across the width of said panel at a generally perpendicular angle relative to said side edges thereof, such that the panels may be folded into a ventilating configuration with at least one of the planar surfaces of each of the panels being in close confronting contact with at least one of the planar surfaces of an adjoining one of the panels to form a pair of ventilator sections which may be disposed on each side of the open cutout in the roof and secured thereto, thereby permitting ventilation through the air passages from the open cutout of the roof to the exterior region surrounding the ventilator cover.

16. The ventilator cover of claim 15 wherein the plurality of panels include a pair of end panels, a first pair of intermediate panels, a second pair of intermediate panels, a third pair of intermediate panels, a fourth pair of intermediate panels, and a pair of center panels, and wherein the sheet material includes a pair of generally spaced-apart planar plies including a top ply and a bottom ply and a convoluted intermediate ply connected to and extending between said pair of planar plies and defining the air passages, said center panels being hingedly connected to one another along the lengths thereof by said top ply, each of said center panels being hingedly connected to one of said fourth pair of intermediate panels along the lengths thereof by said bottom ply, each of said fourth pair of intermediate panels being hingedly connected to one of said third pair of intermediate panels along the lengths thereof by said top ply, each of said third pair of intermediate panels being hingedly connected to one of said second pair of intermediate panels along the lengths thereof by said bottom ply, each of aid second pair of intermediate panels being hingedly connected to one of said first pair of intermediate panels along the lengths thereof by said top ply, and each of said first pair of intermediate panels being hingedly connected to one of said end panels along the lengths thereof by said bottom ply.

17. The ventilator cover of claim 16 wherein the ventilator cover has a widthwise center, the end panels have a width, the first pair of intermediate panels have a width and are disposed closer to said widthwise center than the end panels, the second pair of intermediate panels have a width and are disposed closer to the widthwise center than the first pair of intermediate panels, the third pair of intermediate panels have a width and are disposed closer to the widthwise center than the second pair of intermediate panels, the fourth pair of intermediate panels have a width and are disposed closer to the widthwise center than the third pair of intermediate panels, and the center panels each have a width disposed closer to the widthwise center than the fourth pair of intermediate panels.

18. The ventilator cover of claim 17 wherein the width of the first pair of intermediate panels is greater than the width of the end panels, the width of the second pair of intermediate panels is greater than the width of the first pair of intermediate panels, the width of the third pair of intermediate panels is greater than the width of the second pair of intermediate panels, the width of the fourth pair of intermediate panels is greater than the width of the third pair of intermediate panels, and the width of the center panels is greater than the width of the fourth pair of intermediate panels.

19. The ventilator cover of claim 17 wherein the width of each of the end panels is between two and three inches, the width of each of the first pair of intermediate pane)s is between three and four inches, the width of each of the second pair of intermediate panels is between three and four inches, the width of each of the third pair of intermediate panels is between four and five inches, the width of each of the fourth pair of intermediate panels is between four and five inches, and the width of each of the center panels is greater than five inches.

20. A method of forming a ventilator cover for disposing over an open cutout in a peak of a roof and providing ventilation between said open cutout and an exterior region surrounding said ventilator cover, said method comprising the steps of:

cutting a sheet of double faced corrugated sheet material having a pair of generally spaced -apart planar plies including a top ply and a bottom ply and a convoluted intermediate ply defining a multiplicity of partially enclosed air passages oriented along a grain into a generally rectangular blank having a length and a width;

alternately scoring said top ply and said bottom ply in a direction perpendicular to said grain to form a plurality of hingedly interconnected panels, each panel having a pair of opposing planar surfaces and pair of opposing side edges and a multiplicity of air passages extending between said side edges and being open along said side edges, each said panel being hingedly connected to an adjoining panel by said top ply or said bottom ply along a score line cut through said intermediate ply and one of said bottom ply or said top ply;

folding said panels along said score lines such that at least one of said opposing planar surfaces of said panel is pivoted into close confronting contact with at least one of the opposing planar surfaces of an adjoining panel; and disposing the ventilator cover over the open cutout in the roof with the length of the blank being generally parallel to the peak the multiplicity of partially enclosed air passages being oriented generally perpendicularly to said peak and securing the ventilator cover to the roof, whereby air may pass between the open cutout of the roof and the exterior region surrounding the ventilator cover by passing through the partially enclosed air passages of the panels.

* * * * *